United States Patent [19]

Ståhl

[11] 4,118,600

[45] Oct. 3, 1978

[54] LOUDSPEAKER LOWER BASS RESPONSE USING NEGATIVE RESISTANCE AND IMPEDANCE LOADING

[76] Inventor: Karl Erik Ståhl, Haggviksvägen 14, Sollentuna, Sweden

[21] Appl. No.: 780,454

[22] Filed: Mar. 23, 1977

[30] Foreign Application Priority Data

Mar. 24, 1976 [SE] Sweden ..... 7603585

[51] Int. Cl.[2] ..... H04R 3/00; H04R 3/08

[52] U.S. Cl. ..... 179/1 D; 333/80 R; 330/107; 330/112; 179/1 A; 179/1 F

[58] Field of Search ..... 179/1 F, 1 D, 1 A; 333/80 R

[56] References Cited

U.S. PATENT DOCUMENTS

| | | | |
|---|---|---|---|
| 3,530,244 | 9/1970 | Reiffen | 179/1 F |
| 3,889,060 | 6/1975 | Goto | 179/1 F |

FOREIGN PATENT DOCUMENTS

| | | | |
|---|---|---|---|
| 2,269,267 | 4/1974 | France | 179/1 F |
| 2,235,664 | 7/1972 | Fed. Rep. of Germany | 179/1 F |

OTHER PUBLICATIONS

H. Holdaway, "Design of Velocity-Feedback Trasnsducer Systems for Low Frequency", IEEE Trans. Audio, Sep. 1963, GE Transistor Manual, 7th Edition, 1964, pp. 259, 260.

A. Thiele, "Loud Circuit Stabilizing Networks for Audio Amplifiers", Proc. IEEE Aust., Sep. 1975, vol. 36, No. 9, pp. 297-299.

*Primary Examiner*—Thomas W. Brown
*Assistant Examiner*—E. S. Kemeny
*Attorney, Agent, or Firm*—Birch, Stewart, Kolasch and Birch

[57] ABSTRACT

An apparatus and method for improving the bass response characteristics of an electrodynamic loudspeaker is described. The loudspeaker normally exhibits actual mechanical parameters such as damping, compliance, and mass which normally determine the bass response and lower cut-off frequency of the loudspeaker. The method and apparatus of the present invention cause the loudspeaker to exhibit apparent mechanical parameters which differ from the actual mechanical parameters to substantially change the effect of the actual mechanical parameters on the bass response. The apparatus in a preferred embodiment includes an electrical network through which electrical energy corresponding to the sound to be reproduced is applied to the voice-coil of the loudspeaker. The electrical network has an effective output impedance including a negative impedance in series with a plurality of impedances connected in parallel. The value of the negative impedance (including negative resistance) is chosen to be substantially equal to the impedance of the voice-coil. The plurality of parallel impedances have values which cause the loudspeaker to exhibit apparent mechanical parameters which are substantially different from the actual mechanical parameters in the bass response of the loudspeaker.

32 Claims, 21 Drawing Figures

Figure 1:
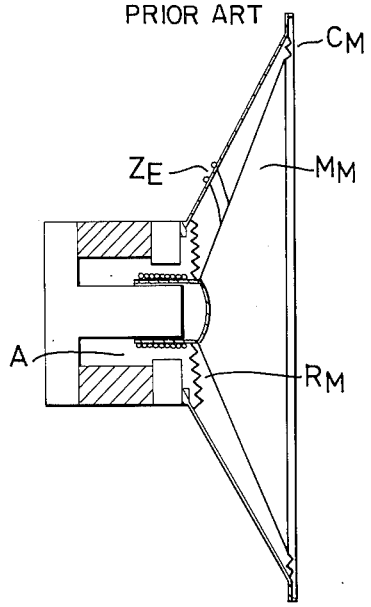
Fig. 1 PRIOR ART

| parameter | case a "actual value" | case b changed into | case c changed into |
|---|---|---|---|
| $f_0$ | 70 Hz | 40 Hz | 20 Hz |
| Q | 0,9 | 0,7 | 0,7 |
| $M_{M\ total}$ | 40 g | 130 g | 520 g |
| $R_{M\ total}$ | 17 kg/s | 48 kg/s | 95 kg/s |

LOUDSPEAKER LOWER BASS RESPONSE USING NEGATIVE RESISTANCE AND IMPEDANCE LOADING

The present invention relates to a method of improving the bass response of a loudspeaker and apparatus for carrying out the method. The invention is intended to provide an extended frequency range and lower distortion in the bass register in hi-fi-reproduction. Modern bass speakers often have a lower limit frequency of 50 Hz or above, while other units in the reproduction chain are often capable of reproducing frequencies down to the limit frequency of the ear, approximately 20 Hz. The distortion of the speaker is often the dominating portion of the distortion of the reproduction chain in the lower bass range.

A number of methods are known by which the bass response of a loudspeaker can be improved in one respect or another. One such method involves changing of the tone curve of the amplifier operating the speaker, thereby to compensate the tone curve of the speaker in the bass range. One disadvantage with this method is that it may be necessary to provide complicated filters; another disadvantage is that such compensation is sensitive to variations in the mechanical parameters of the speakers.

According to another known method, feed-back is effected from the speaker to the operating amplifier, for example by means of an acceleration transducer mounted on the speaker diaphragm. According to general control theory, this method should provide reduced distortion and increased frequency range in the bass register. In practice, however, certain problems are encountered, and hence it is difficult to provide any appreciable improvment. Moreover, this method is not suitable for use with bass reflex cabinets, since the diaphragm amplitude in such cabinets is not directly related to the sound pressure.

A further known method for improving the sound response of a loudspeaker, which need not necessarily be a bass speaker, requires the speaker to be connected in series with a parallel resonance circuit, for example as described in the German Patent Specification 2,029,841.

It is also known that the response of a speaker can be improved by changing the influence of the voice-coil resistance. This can be effected by operating the speaker with an amplifier having suitable output resistance, obtained, for example, by current feed-back, in accordance with German Patent Specification 2,235,664.

According to the present invention the loudspeaker whose bass response is to be improved is operated with an amplifier or an amplifier combination whose effective output impedance includes or is equivalent to a negative resistance connected in series with a parallel resonance circuit, over which operation is effected with a current generator, the negative resistance having substantially the same value as the resistance of the voice-coil of the speaker. By operating a loudspeaker with such an amplifier, there can be obtained a change in the bass response of the speaker, which is equivalent to a change in the mechanical parameters of the speaker element and its moving mass, damping and compliance.

The present invention makes use of the fact that the physical characteristics of an electrodynamic speaker element satisfy the mathematical chain matrix of a gyrator in a two port electrical network. This fact is utilized in combination with a mechanical electrical analogy of the speaker characteristics to arrive at the electrical network of the present invention.

Means are provided to substantially cancel the voice-coil impedance of the system to achieve a parallel relationship between the electrical components in the equivalent circuit of the present invention at the input of the speaker and the mechanical-electrical equivalents of the speaker parameters.

It is preferred to apply the energy to be reproduced to the speaker from an equivalent circuit including a current source in parallel with the selected resistive, inductive, and capacitive impedance elements of the present invention. A voltage source may be used. However, a suitable voltage source is more difficult to achieve because it is frequency dependent.

Figure 2A:
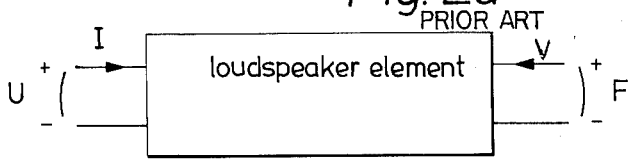
Fig. 2a PRIOR ART
Figure 2B:
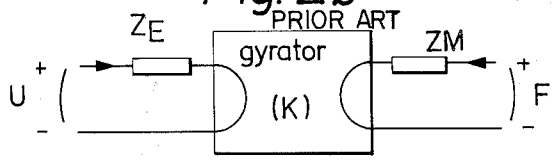
Fig. 2b PRIOR ART
Figure 2C:
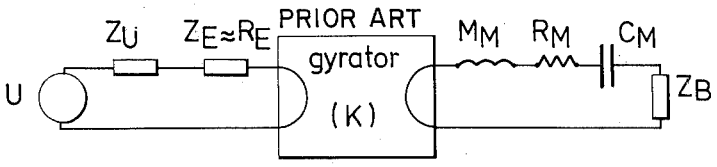
Fig. 2c PRIOR ART
Figure 4A:
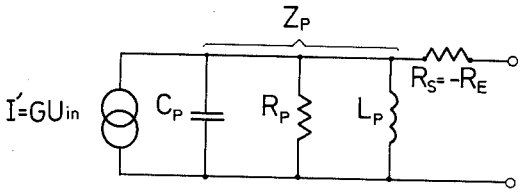
Figure 4B:
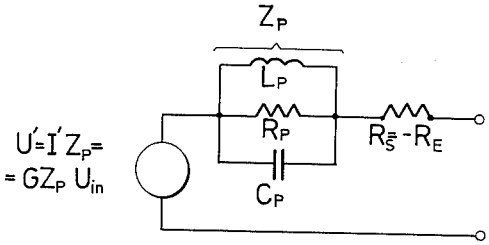
Figure 5A:
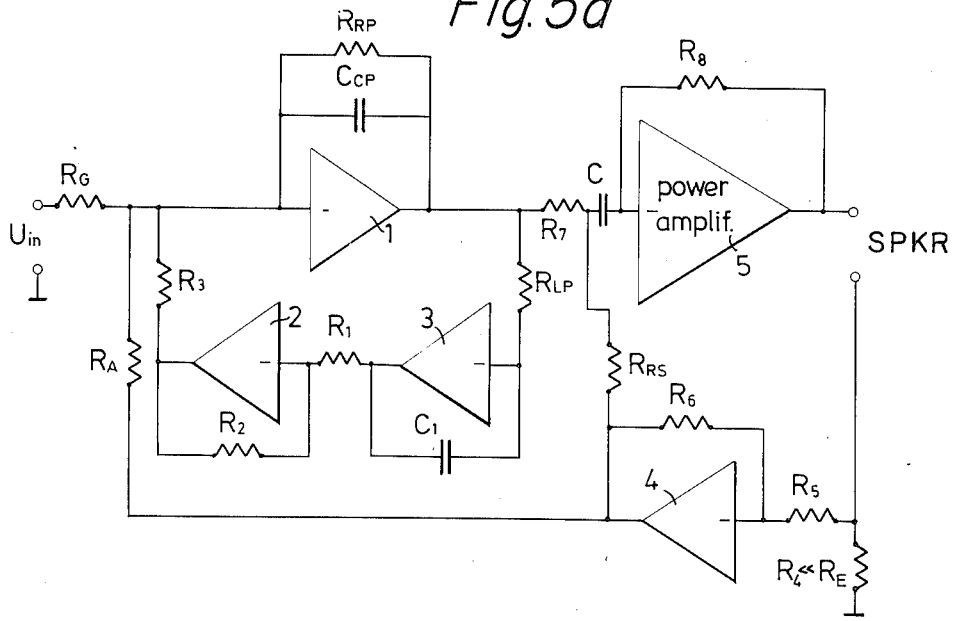
Figure 5B:
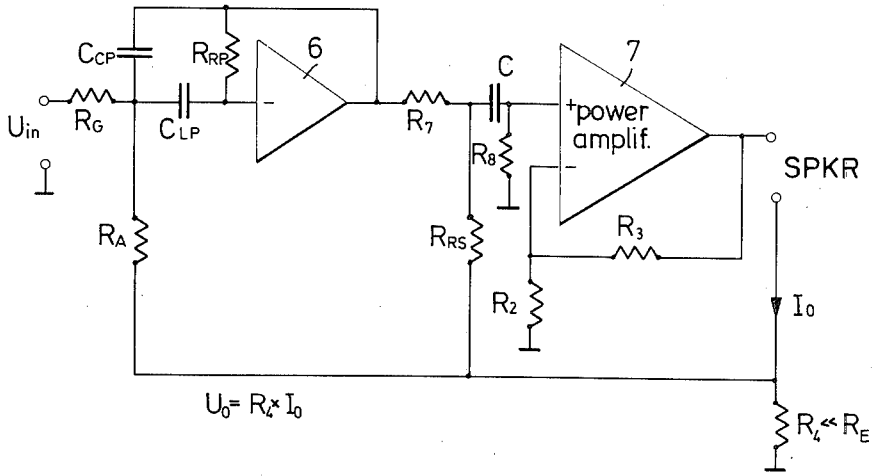
Figure 6:
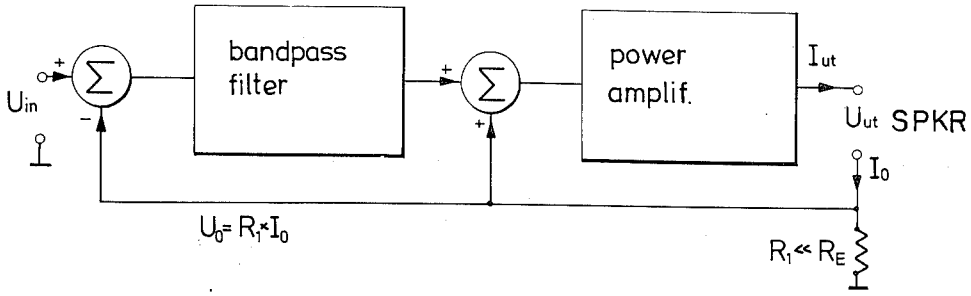
Figure 7:
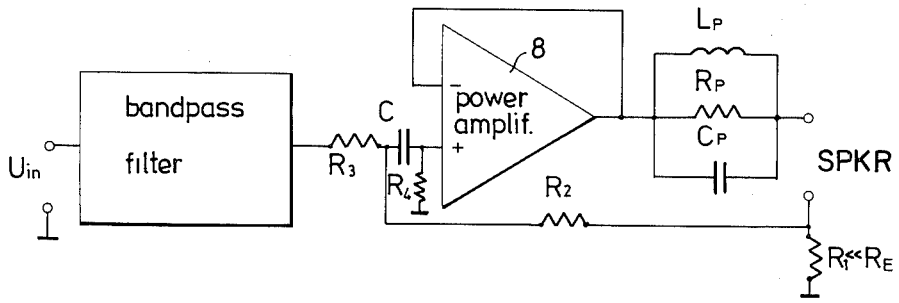
Figure 8A:
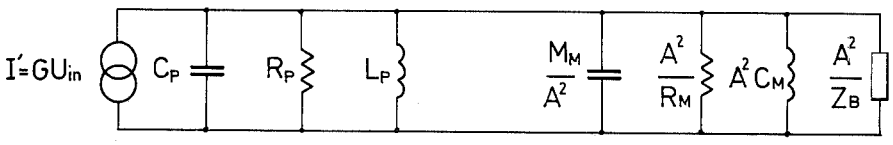
Figure 8B:
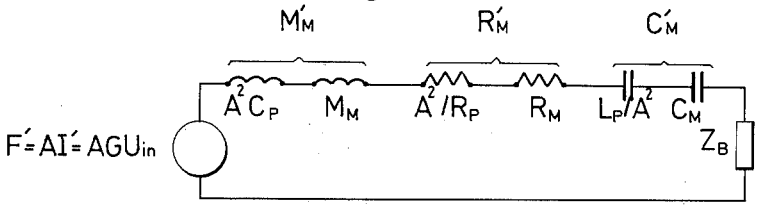
Figure 9:
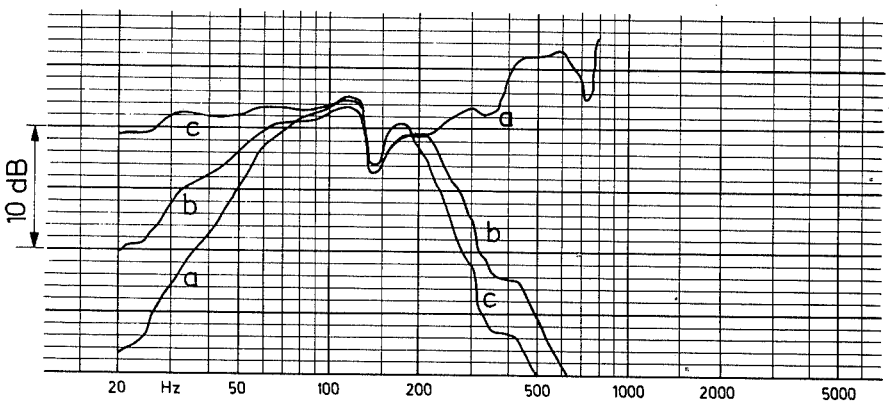
Figure 10A:
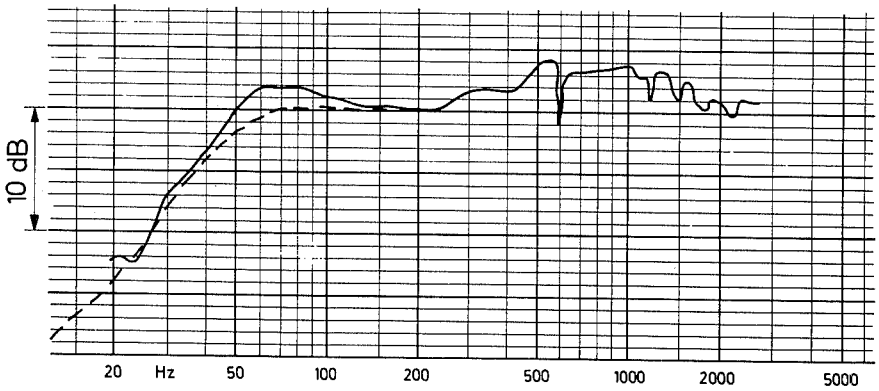
Figure 10B:
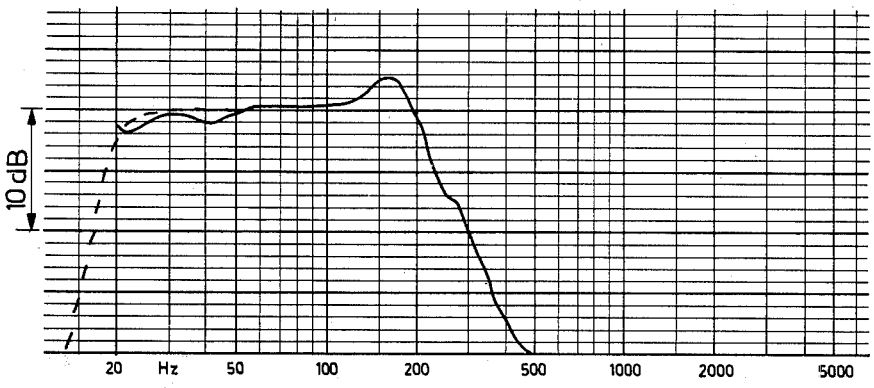
Figure 11:
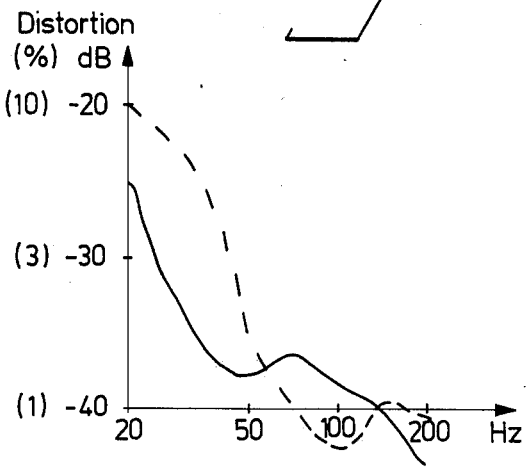

The invention will now be described in more detail with reference to the accompanying drawings; in which:

FIG. 1 is a sectional view of a loudspeaker element;

FIGS. 2*a*–2*c* show two port networks describing the speaker element;

FIGS. 3*a*–3*d* show equivalent circuits for the networks seen from the electrical and mechanical side respectively;

FIGS. 4*a* and 4*b* show equivalent circuits for the amplifier or the amplifier combination which can be used in accordance with the invention;

FIGS. 5*a*, 5*b* and 6 are circuit diagrams of one embodiment of an amplifier combination which can be used in accordance with the invention;

FIG. 7 shows an alternative embodiment of an amplifier for use in accordance with the invention;

FIGS. 8*a*–8*b* are equivalent circuits for the system comprising an amplifier and loudspeaker element combination according to the invention and 8*c* according to conventional operation from an amplifier with constant voltage amplification and pure resistive output impedance, and FIGS. 9–11 show a table and four curves showing the results of tests carried out in conjunction with the invention.

FIG. 1 is a sectional view through a loudspeaker element whose bass response is to be improved, those elements which are not relevant to the invention being omitted for the sake of clarity. The loudspeaker element is of the electrodynamic type, i.e. a voice-coil is moveable in an air gap between the poles of a magnet. The reference A is the product of the strength of the magnetic field and the length of the voice-coil conductor in the air gap. At lower frequencies, the electrical impedance $Z_E$ of the voice-coil can, with good approximation, be considered to be purely resistive with value $R_E$. Movement of the moving coil is transmitted to a diaphragm having a moving mass $M_M$, damping $R_M$ and compliance $C_M$, wherewith sound can be reproduced.

To describe the mechanical movement in the speaker element, there can be used a mechanical-electrical analogy, in which mechanical force is treated as electric voltage, velocity as current, mass as inductance, damping as resistance and compliance as capacitance. The relationship between the electrical and mechanical sides of the speaker element can thus be described with a two port network according to FIG. 2*a* having a voltage U and current I with respect to the electrical sides and force F, velocity V with respect to the mechanical side.

By using the designations and assumptions according to FIGS. 1 and 2*a*, the speaker element can be described with reference to FIG. 2*b*, in which $Z_M$ is the mechanical impedance of the speaker element, said impedance comprising its moving mass $M_M$, damping $R_M$ and compliance $C_M$. The gyrator has a chain matrix $$(K) = \begin{pmatrix} 0 & -A \\ -1/A & 0 \end{pmatrix}$$

and has the properties such that the dual of the network connected to one side can be seen from the other side thereof. FIG. 2*b* can be summarized in the equations: $U = Z_E I + AV$, $F = -AI + Z_M V$.

With normal use of a loudspeaker element, the speaker is operated by an amplifier having an output impedance $Z_U$, and on the mechanical side there occurs, as a result of the ambient air, a mechanical impedance $Z_B$, which loads the diaphragm. The system comprising an amplifier and a loudspeaker combination can then be described with reference to FIG. 2*c*.

Figure 3A:
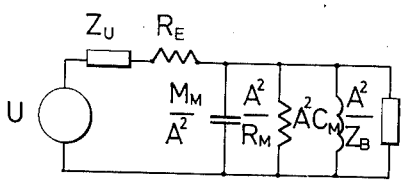
Fig.3a PRIOR ART
Figure 3B:
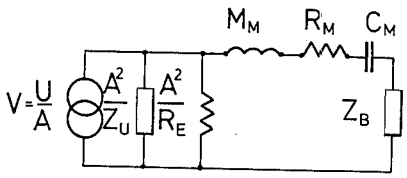
Fig. 3b PRIOR ART
Figure 3C:
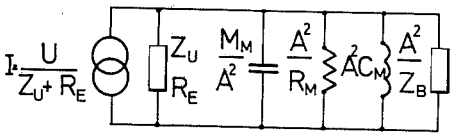
Fig. 3c PRIOR ART
Figure 3D:
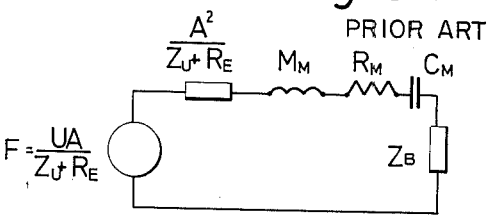
Fig. 3d PRIOR ART

FIGS. 3*a* and 3*b* show circuits equivalent with the system in FIG. 2*c* viewed from the electrical and mechanical side respectively. Since a voltage generator connected in series with an impedance is equivalent to a current generator connected in parallel with the same impedance, the circuits shown in FIGS. 3*c* and 3*d* are alternatives to the circuits shown in FIGS. 3*a* and 3*b* for describing the system shown in FIG. 2*c* when viewed from the electrical and mechanical side respectively.

FIGS. 4*a* and 4*b* show the equivalent circuits for the amplifier used in accordance with the invention for operating the speaker. The effective output impedance of the amplifier comprise or are equivalent to a negative resistance $R_s$, connected in series with a parallel resonance circuit $Z_p$ comprising a capacitor $C_p$, a resistance $R_p$ and an inductance $L_p$. The value of the negative resistance is equal to or substantially equal to the resistance $R_E$ of the voice-coil. When the amplifier or the amplifier combination drives the loudspeaker element through electric conductors, which owing to their length or other circumstances have a resistance not negligible with respect to the resistance of the voice-coil, the value of the negative resistance $R_s$ shall substantially coincide with the sum of the resistances of said conductor and voice-coil. In FIG. 4*a* the source of the power is shown as a current generator parallel with the resonance circuit. If the source is regarded as a voltage generator instead, as shown in FIG. 4*b*, the output voltage of the generator shall vary with the frequency in the same manner as the impedance $Z_p$ of the parallel resonance circuit.

FIG. 5*a* is a circuit diagram of an amplifier combination having an effective output impedance which is at least approximately equivalent to a negative resistance $R_s$ connected in series with a parallel resonance circuit $C_p$, $R_p$, $L_p$, wherewith the following relationship between the impedances and component values is applicable.

$$R_s = \sim \frac{1}{R_{Rs}} \cdot \frac{R_4 R_6 R_8}{R_5} \quad C_p = C_{Cp} \frac{R_A R_5 R_7}{R_4 R_6 R_8}$$

$$R_p = R_{Rp} \frac{R_4 R_6 R_8}{R_A R_5 R_7} \quad L_p = R_{Lp} \frac{R_1 R_3 C_1}{R_2} \cdot \frac{R_4 R_6 R_8}{R_A R_5 R_7}$$

$$G = \frac{1}{R_G} \cdot \frac{R_A R_5}{R_4 R_6}$$

G is the amplification constant in FIGS. 4*a* and 4*b*.

As seen from the above indicated equations the various parameters $R_s$, $C_p$, $R_p$, $L_p$ and G may be varied independently of each other by varying $R_{Rs}$, $C_{Cp}$, $R_{Rp}$, $R_{Lp}$ and $R_G$ respectively.

As an example of a proper design of the circuit shown in FIG. 5*a* the following component values may be selected:

$R_4 = 0.1\Omega$,
$R_5 = 1k\Omega$,
$R_6 = 10k\Omega$

This particular selection implies that the voltage (measured in volts) at the output of operational amplifier 4 will be equal to the current (measured in amperes) through the loudspeaker element.

$R_1 = R_2 = R_3 = 10k\Omega$,
$R_7 = 10k\Omega$,
$R_8 = 100k\Omega$,
$R_A = 100k\Omega$,
$C_1 = 1\mu F$ This particular selection implies that it will be easy to calculate $R_s$, $C_p$, $R_p$, $L_p$ and G.

If the resistance is measured in ohms, the capacitance in farads and the inductances in henrys then $R_s = -10^5/R_{Rs}$,
$C_p = C_{Cp} \cdot 10^4$ F,
$R_p = R_{Rp} \cdot 10^{-4}$ $$L_p = R_{Lp} \cdot 10_H^{-6}$$

and $$G = 10^5/R_G \text{ mhos } (= 1/\Omega)$$

Operational amplifiers 1–4 may be of the type μA 741. Power amplifier 5 is of conventional type and shall exhibit operational amplifier characteristics.

FIG. 5*b* shows a simpler embodiment of an amplifier for use in accordance with the invention. Compared with the circuit shown in FIG. 5*a*, this circuit has the disadvantage that the different parameters $R_s$, $C_p$, $R_p$, $L_p$ and G cannot be varied independently of each other with only one component.

FIG. 6 is a block diagram of the circuits shown in FIGS. 5*a* and 5*b*. Each part of the block diagram i.e. the adder, and filter etc., can be realised in other ways than that shown in FIGS. 5*a* and 5*b*. Other circuits in which filter functions are permitted to be included in the power amplifier are conceivable.

In FIG. 5*a* a band pass filter is formed by components $R_G$, 1, $C_{Cp}$, $R_{Rp}$, $R_{Lp}$, 3, $C_1$, $R_1$, 2, $R_2$, $R_3$ and $R_G$. Components $R_G$, 1, $R_{Rp}$ and $R_A$ form a first summator. The voltage at the output of operational amplifier 4, said voltage being proportional to the current through the loudspeaker element, is added to the input voltage U in said summator. Components $R_7$, C, $R_8$ and 5 form an AC connected power amplifier. DC offset voltage will thereby be eliminated by the large capacitor C (larger than 100 μF with the above indicated values of the components). A second summator is formed by components $R_7$, $R_8$, 5, $R_{Rs}$. The voltage at the output of operational amplifier 4 will be added to the output voltage from the band pass filter.

In FIG. 5*b* components $R_G$, $C_{Lp}$, operational amplifier 6, $R_{Rp}$ and $C_{Cp}$ form a band pass filter. Components $R_G$, $C_{Lp}$, 6, $R_{Rp}$, $C_{Cp}$ and $R_A$ form a first summator. A second summator is formed by components $R_7$, C, $R_8$, 7, $R_2$, $R_3$ and $R_{Rs}$. In FIG. 5*b* the time constant of the link C . $R_8$ should be large.

An alternative embodiment of an amplifier for use in accordance with the invention is shown in FIG. 7. Compared with the circuits in FIGS. 5*a* and 5*b*, this circuit has the disadvantages that the impedances in the resonance circuit on the output have, from the practical aspect, unsuitable values, and that the band pass filter on the input must be adapted in a specific manner to the resonance circuit on the output.

In the same manner as in FIG. 5*b* the time constant of link C. $R_4$ in FIG. 7 is selected large.

When using amplifiers or amplifier combinations according to the invention with the equivalent circuit according to FIG. 4 or the circuit diagram according to FIGS. 5–7, the system amplifier-speaker element can be described, seen from the electrical and mechanical side, with the equivalent circuit diagram according to FIGS. 8*a* and 8*b* respectively. With the conventional operation of a loudspeaker element from an amplifier having a substantially pure resistive output impedance there is obtained, however, — seen from the mechanical side — an equivalent circuit according to FIG. 8*c*.

Figure 8C:
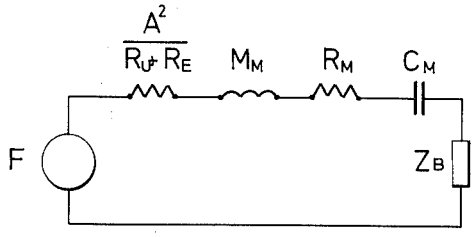

When comparing FIGS. 8*b* and 8*c*, it will be seen that, in accordance with the invention, there can be obtained a change in the speaker response which is equivalent to a change in the mechanical parameters of the speaker. Compared with the conventional operation of the loudspeaker element, there is obtained in accordance with the invention an apparent increase in the moving mass of the loudspeaker element and an apparent change in damping and an apparent decrease of the compliance. The relationship between apparent mass $M_M''$, apparent damping $R_M''$ and apparent resiliency $C_M''$ and corresponding original magnitudes is given by:

$$M_M'' = M_M + A^2C_p$$

$$R_M'' = R_M + A^2/R_p$$

$$C_M'' = (C_ML_p/A^2)/(C_M + L_p/A^2)$$

By suitable selection of the impedances $C_p$, $R_p$ and $L_p$ in the parallel resonance circuit in the output impedance of the amplifier or amplifier combination, the parameters of the speaker element can be changed so that there is obtained a change in the frequency range of the loudspeaker. By making one or more of the apparent parameters $M_M''$, $R_M''$ and $C_M''$ dominate over the actual parameters $M_M$, $R_M$ and $C_M$, that portion of the distortion caused by the non-linearity of the actual parameters can also be reduced. The requirement in this respect is that A is linear and that the diaphragm is stiff and securely connected to the moving coil so that the apparent changes are substantially linear.

Using the above equations the desired values of $C_p$, $R_p$ and $L_p$ can be calculated. Assuming that it is desired to select $C_p = 5 \cdot 10^{-3}$ F, $R_p = 1.5\ \Omega$ and $L_p = 2 \cdot 10^{-2}$ H. Further, it is assumed that for a specific loudspeaker element having the resistance $R_E = 6$ ohm the amplification constant G should be 4, then if the previously indicated component values are used, the following values of $R_{Rs}$, $C_{Cp}$, $R_{Rp}$, $R_{Lp}$ and $R_G$ are achieved:

$R_{Rs} = 16.7\ k\Omega, C_{Cp} = 0.5\ \mu F$,
$R_{Rp} = 15\ k\Omega$,
$R_{Lp} = 20\ k\Omega$ and
$R_G = 25k\Omega$ Hitherto only the case when $C_p$, $R_p$ and $L_p > 0$ has been discussed. When ideal conditions prevail, it should at least be theoretically possible to make one or more or these negative and therewith decrease $M_M'$ and $R_M'$ or to increase $C_M'$. This would create a stability problem, however, owing to the fact, inter alia, that $Z_E$ is not purely resistive but also inductive.

Further, it is not necessary for the parallel resonance circuit to contain both a capacitive and an inductive element. If, for example, there is only desired an apparent increase in the mass $M_M$ and a change in the damping $R_M$, the inductive element $L_p$ is not required, then, in FIG. 5*a* the band pass filter described is reduced to a low pass filter and the components $R_{Lp}$, 3, $C_1$, $R_1$, 2, $R_2$ and $R_3$ can be comitted and in FIG. 5*b* capacitor $C_{Lp}$ is short circuited.

FIG. 9 shows a table and tone curves measured in an anechoic chamber in respect of a 12 inch loudspeaker element mounted in a 37 liter closed box. With normal operation at a constant voltage amplitude there is obtained a lower limit frequency $f_o$ of about 70 Hz and a Q-factor of approximately 0.9. A calculated decrease in the Q-factor to 0.7 and in the lower limit frequency to 40 and 20 Hz respectively is obtained by the apparent increase of the moving mass and damping in accordance with the invention, see the table.

The full-line curve shown in FIG. 10*a* was obtained when operating an 8.5 inch loudspeaker element at constant voltage amplitude mounted in a 43 liter bass-reflex box measured in an anechoic chamber. The full-line curve in FIG. 10*b* is measured in an anechoic chamber for the same loudspeaker, in which the mass and damping of the loudspeaker element were apparently increased and the compliance decreased in accordance with the invention. The corresponding dash-line curves are calculated theoretically. The system is dimensioned together with a second order highpass filter in the amplifier to behave as a sixth order Butterworth filter with the limit frequency 20 Hz. The system is also supplemented with a low-pass RC-link with the limit frequency 100 Hz so as, together with the influence of the voice-coil inductance to be used as a crossover network. The distortion is clearly reduced at low frequencies compared with operation using constant voltage amplitude, but increased around 100 Hz when the speaker is operated in accordance with the invention. The increase around 100 Hz was due to the fact that the voice-coil inductance was nonlinear.

The behaviour of the distortion of a loudspeaker system in which the nonlinearity of the voice-coil inductance was eliminated is shown in FIG. 11. The full-curve applies to a loudspeaker operated in accordance with the invention, while the dash-line curve applies to the speaker when operated with an amplifier having a negligible output impedance. The signal was adapted in both cases to the speaker so that the acoustic output level at each frequency was 90 $dB_{spl}$ at 1 meter distance in free space.

Although the invention has been described with reference to a number of embodiments thereof and tests made in conjunction therewith, the invention is not restricted to these embodiments. The loudspeaker need not necessarily be of the type shown in FIG. 1 and the output impedance and manner of operation of the amplifier or the amplifier combination need not be of the exact nature shown in FIGS. 4*a* and 4*b*. Moreover, it may sometimes be appropriate to adjust $R_s$ so that $R_s + R_E$ will be larger than zero (up to about 0.4 times $R_E$) in order to adjust the Q-value at the upper limit frequency.

For further information reference is made to an examination thesis entitled "Control of Loudspeaker Mechanical Parameters by Electrical Means" by Karl Erik Ståhl, Royal Institute of Technology (KTH). Department of speech communication, S-100 44 Stockholm, Sweden, March 1976.

I claim:

1. An apparatus for improving the bass response of an electrodynamic loudspeaker comprising:

means including an electrical network for applying electrical energy corresponding to the sound to be reproduced to a voice-coil in said loudspeaker, said means having an effective output impedance substantially equivalent to a negative resistance in series with a plurality of impedances disposed in a parallel circuit;

said negative resistance being substantially equal in magnitude to the resistance of said voice-coil; and said impedances in said parallel circuit having such values that the reactance of said parallel circuit has a significant influence on the bass response of said loudspeaker.

2. An apparatus in accordance with claim 1, said apparatus comprising:

an input terminal receiving an input voltage corresponding to the sound to be reproduced, an output terminal at which a loudspeaker element is connected, and means for deriving a voltage which is proportional to the current through said loudspeaker element, first summator circuit means connected to said input terminal for subtracting from the input voltage a first fraction of the voltage from said voltage deriving means, filter circuit means connected to the output of said summator circuit means, second summator circuit means connected to the output of said filter circuit means for adding to the output signal from said filter circuit means a second fraction of the voltage from said voltage deriving means, and power amplifier circuit means connected between the output of said second summator circuit means and said output terminal.

3. An apparatus in accordance with claim 2, wherein said filter circuit means comprises a first resistor in series with a first operational amplifier and a first parallel combination including a second resistor in parallel with said first amplifier.

4. An apparatus in accordance with claim 3 further including a first capacitor in parallel with said first amplifier, and a second parallel combination connected in parallel with said first parallel combination, said second parallel combination comprising a third resistor in series with a second operational amplifier which is in series with a fourth resistor which in turn is in series with a third operational amplifier connected in series with a fifth resistor, said second amplifier being shunted with a second capacitor and said third operational amplifier being shunted with a sixth resistor.

5. An apparatus in accordance with claim 3 wherein said first summator circuit means comprises a sixth resistor connected at one end to the common point between said first and fifth resistors and at the other end to said voltage deriving means.

6. An apparatus in accordance with claim 5 wherein said power amplifier circuit means comprises a seventh resistor in series with a third capacitor connected in series with a fourth power operational amplifier which is shunted with an eighth resistor.

7. An apparatus in accordance with claim 6 wherein said second summator circuit means comprises a ninth resistor connected at one end thereof to the common point between the seventh resistor and third capacitor and at the other end thereof to said voltage deriving means.

8. An apparatus in accordance with claim 7 wherein said voltage deriving means comprises a fifth operational amplifier connected to said output terminal at which the loudspeaker element is connected, via a tenth resistor, said fifth amplifier being shunted with an eleventh resistor, the output of said fifth amplifier being connected to said other end of said sixth and ninth resistors respectively, and a twelwth resistor connected between said output terminal, at which the loudspeaker element is connected, and earth.

9. An apparatus in accordance with claim 3, wherein said filter circuit means further comprises a first capacitor one terminal of which is connected to the common point between said first resistor and the input of said first operational amplifier and the other terminal of which is connected to the output of said first operational amplifier, said second resistor being connected at one end thereof to the input and at its other end to the output of said first amplifier.

10. An apparatus in accordance with claim 9 wherein said filter circuit means further comprises a second capacitor interposed in series between said one end of said second resistor and the input of said first operational amplifier.

11. An apparatus in accordance with claim 9 wherein said first summator circuit means comprises a third resistor connected at one end thereof to the common point between said first resistor and said first capacitor and at the other end thereof to said voltage deriving means.

12. An apparatus in accordance with claim 9 wherein said power amplifier circuit means comprises a third capacitor connected to one input of a second power operational amplifier, a fourth resistor connected to the common point between said third resistor and said first input of the second power operational amplifier, a fifth resistor connected between the output of said second power operational amplifier and a second input thereof and a sixth resistor connected between said second input and earth.

13. An apparatus in accordance with claim 11 wherein said second summator circuit means comprises a seventh resistor connected between the output of said first operational amplifier and said third capacitor, and an eight resistor connected at one end thereof at the common point of said seventh resistor and said third capacitor and at the other end thereof to the output of said voltage deriving means.

14. An apparatus in accordance with claim 12 wherein said voltage deriving means comprises a ninth resistor connected between said terminal at which the loudspeaker element is connected, and earth, whereby said other end of third and eight resistor respectively is connected to said output terminal at which the loudspeaker element is connected.

15. A method for improving the bass response of an electrodynamic loudspeaker having a voice-coil with a predetermined impedance and actual mechanical parameters including damping and reactive parameters of mass and compliance, said actual reactive mechanical parameters ordinarily controlling the lower bass cut-off frequency of the bass response of the loudspeaker, comprising the steps of:

substantially cancelling said voice-coil impedance;

applying electrical energy to said loudspeaker corresponding to the sound to be reproduced within said bass response from an electrical network having an effective output impedance comprising a plurality of constituent impedance elements the values of which have an effect on the values of predetermined reactive apparent mechanical parameters which the loudspeaker exhibits when connected to said network; and selectively operating on said electrical energy to constrain said loudspeaker to exhibit apparent reactive mechanical parameters with values substantially different from the value of at least one of said actual reactive mechanical parameters to substantially change the lower base cut-off frequency of the loudspeaker by choosing the value of a selected constituent impedance element in said electrical network which affects the selected apparent reactive mechanical parameters to be changed.

16. The method in accordance with claim 15 wherein said electrical network has a constituent impedance element the value of which affects the apparent damping that the loudspeaker exhibits, and including the further step of:

selecting the value of said constituent impedance element which affects said apparent damping so that said apparent damping is different from the actual damping in the bass response of the loudspeaker.

17. The method in accordance with claim 15 wherein said electrical energy corresponding to said sound is applied to said loudspeaker by a current generator effectively connected in parallel with said constituent impedance elements.

18. A method for improving the bass response of an electrodynamic loudspeaker having a voice-coil with a predetermined impedance and actual mechanical parameters including damping and reactive parameters of mass and compliance, said actual reactive mechanical parameters ordinarily controlling the lower bass cut-off frequency of the bass response of the loudspeaker, comprising the steps of:

applying electrical energy to said loudspeaker corresponding to the sound to be reproduced within said bass response from an electrical network having an effective output impedance determined by a negative impedance connected in series with a plurality of constituent impedance elements connected in a parallel circuit, the values of said constituent impedance elements having an effect on the values of predetermined reactive apparent mechanical parameters which the loudspeaker exhibits;

selectively operating on said electrical energy to constrain said loudspeaker to exhibit apparent reactive mechanical parameters with values which are substantially different from at least one of said actual reactive mechanical parameters to substantially change the lower bass cut-off frequency of the loudspeaker by choosing the value of a selected constituent impedance element in said electrical network which affects the selected apparent reactive mechanical parameter to be changed; and selecting the value of said negative impedance to be substantially equal in magnitude to said voice-coil impedance.

19. The method in accordance with claim 18, wherein said electrical energy corresponding to said sound is applied to said loudspeaker by a current generator effectively connected in parallel with said constituent impedance elements.

20. An apparatus for improving the bass response of an electrodynamic loudspeaker having a voice-coil with a predetermined impedance and actual mechanical parameters including damping and reactive parameters of mass and compliance, said actual reactive mechanical parameters ordinarily controlling the lower bass cut-off frequency of the bass response of the loudspeaker comprising:

means for applying electrical energy to said loudspeaker corresponding to the sound to be reproduced within said bass response, said means including an electrical network having an effective output impedance determined by a plurality of constituent impedance elements the values of which have an effect on the values of predetermined reactive apparent mechanical parameters which the loudspeaker exhibits;

said constituent impedance elements having such values that at least one of said reactive apparent mechanical parameters is substantially different from the corresponding one of said actual reactive mechanical parameters to substantially change the lower bass cut-off frequency of the loudspeaker; and means for substantially cancelling said voice-coil impedance.

21. The apparatus in accordance with claim 20, wherein said electrical network has a constituent impedance element with a value which causes the loudspeaker to exhibit an apparent damping which is different from the actual damping in the bass response of the loudspeaker.

22. The apparatus in accordance with claim 20 wherein said electrical network includes current generator means for supplying electrical energy corresponding to said sound in parallel with said constituent impedance elements.

23. An apparatus for improving the bass response of an electrodynamic loudspeaker having a voice-coil with a predetermined impedance and actual mechanical parameters including damping and reactive parameters of mass and compliance, said actual reactive mechanical parameters ordinarily controlling the lower bass cut-off frequency of the bass response of the loudspeaker, comprising:

means for applying electrical energy to said loudspeaker corresponding to the sound to be reproduced within said bass response;

said means including electrical network having an effective output impedance determined by a negative impedance connected in series with a plurality of constituent impedance elements connected in a parallel circuit, the values of said constituent impedance element having an effect on the values of predetermined reactive apparent mechanical parameters which the loudspeaker exhibits;

said constituent impedance elements having such values that at least one of said reactive apparent mechanical parameters is substantially different from the corresponding one of said actual reactive mechanical parameters to substantially change the lower bass cut-off frequency of said loudspeaker;

the value of said negative impedance being substantially equal in magnitude to said voice-coil impedance.

24. An apparatus in accordance with claim 23 wherein said electrical network includes current generator means for supplying electrical energy corresponding to said sound in parallel with said constituent impedance elements.

25. A method for improving the bass response of an electrodynamic loudspeaker comprising the steps of:

applying electrical energy corresponding to the sound to be reproduced to a voice-coil in said loudspeaker from an electrical network having an effective output impedance substantially equivalent to a negative resistance in series with a plurality of impedances disposed in a parallel circuit;

selecting said negative resistance to be substantially equal in magnitude to the resistance of said voice-coil; and selecting the values of said plurality of impedances in said parallel circuit so that the reactance thereof has a significant influence on the base response of said loudspeaker.

26. The method in accordance with claim 25, wherein said parallel circuit is a parallel resonant circuit.

27. The apparatus of claim 1, wherein said parallel circuit is a parallel resonant circuit.

28. A method for improving the bass response of an electrodynamic loudspeaker having actual mechanical parameters of mass, compliance and damping controlling the lower cut-off frequency and general bass response of the loudspeaker and a voice-coil with an internal electrical impedance, comprising the steps of:

connecting a negative electrical impedance in series with said voice-coil means and selecting the value of said negative electrical impedance to be substantially equal in magnitude to said internal electrical impedance, whereby said series connected negative impedance and voice coil means constitute a substantially impedance-free voice-coil means;

connecting capacitance means in parallel of said substantially impedance free voice-coil means, whereby the apparent value of said mass exhibited by said loudspeaker becomes substantially different from said actual mechanical mass; and supplying energy to said voice-coil means from a current source connected across said substantially impedance free voice-coil means in parallel with said capacitance means, said current source providing a current varying in frequency and amplitude corresponding to the sound to be reproduced but remaining substantially unaffected by variations in load impedances seen by said current source in the bass frequency range.

29. A method for improving the bass response of an electrodynamic loudspeaker having actual mechanical parameters mass, compliance and damping controlling the lower cut-off frequency and general bass response of the loudspeaker and a voice-coil with an internal electrical impedance, comprising the steps of:

connecting a negative electrical impedance in series with said voice-coil means and selecting the value of said negative electrical impedance to be substantially equal in magnitude to said internal electrical impedance, whereby said series connected negative impedance and voice coil means constitute a substantially impedance-free voice-coil means;

connecting inductance means in parallel to said substantially impedance-free voice-coil means, whereby the apparent value of said compliance exhibited by said loudspeaker becomes substantially different from said actual mechanical compliance; and supplying energy to said voice-coil means from a current source connected across said stubstantially impedance-free voice coil means in parallel with said inductance means, said current source providing a current varying in frequency and amplitude corresponding to the sound to be reproduced but remaining substantially unaffected by variations in load impedance seen by said current source in the bass frequency range.

30. A method for improving the bass response of an electrodynamic loudspeaker having actual mechanical parameters of mass, compliance and damping controlling the lower cut-off frequency and general bass response of the loudspeaker and a voice-coil with an internal electrical impedance, comprising the steps of:

connecting a negative electrical impedance in series with said voice-coil means and selecting the value of said negative electrical impedance to be substantially equal in magnitude to said internal electrical impedance, whereby said series connected negative impedance and voice coil means constitute a substantially impedance-free voice-coil means;

connecting a parallel resonant circuit means in parallel to said substantially impedance-free voice-coil means, whereby the apparent value of said compliance and mass exhibited by said loudspeaker become substantially different from said actual mechanical compliance and mass; and supplying energy to said voice-coil means from a current source connected across said substantially impedance-free voice-coil means in parallel with said parallel resonant circuit means, said current source providing a current varying in frequency and amplitude corresponding to the sound to be reproduced but remaining substantially unaffected by variations in load impedance seen by said current source in the bass frequency range.

31. Loudspeaker apparatus comprising an electrodynamic loudspeaker, and voice-coil means in said loudspeaker having an internal electrical impedance, said loudspeaker exhibiting mechanical parameters of mass, compliance and damping, said mass and compliance determining the mechancial resonance frequency of said loudspeaker and amplifier means having input terminals for receiving electrical signals proportional to the sound to be reproduced by said loudspeaker apparatus, and output terminals connected to said voice-coil means;

circuit means in said amplifier means to give said amplifier means an output impedance characteristic equivalent to a first impedance substantially equal to the negative of said internal impedance, and a second impedance in series with said first impedance, said second impedance containing at least one reactive element which substantially affects the mass or compliance exhibited by said loudspeaker when said voice coil means is connected to said output terminals of said amplifier, whereby the mechanical resonance frequency of said loudspeaker apparatus as measured with short circuited input terminals in substantially lower than the resonant frequency of said loudspeaker with electrically open voice coil means.

32. Loudspeaker apparatus for low bass reproduction, comprising an electrodynamic loudspeaker having voice coil means with a predetermined impedance and exhibiting a mechanical resonance frequency when said voice-coil is electrically open, and amplifier means connected to said voice-coil means;

said amplifier means having an output impedance as seen from said voice coil means comprising a reactive component of substantial magnitude, whereby said loudspeaker exhibits a materially lower mechanical resonance frequency when said voice-coil means is connected to said amplifier than when it is electrically open circuited; and means for substantially cancelling said voice-coil impedance.

* * * * *

UNITED STATES PATENT AND TRADEMARK OFFICE

CERTIFICATE OF CORRECTION

PATENT NO. : 4,118,600

DATED : October 3, 1978

INVENTOR(S) : Karl Erik Stahl

It is certified that error appears in the above-identified patent and that said Letters Patent are hereby corrected as shown below:

IN THE SPECIFICATION:

Column 3, Line 60

Change the formula now reading, in part,

"$R_s = \sim \frac{1}{R_{Rs}}$" to read -- $R_s = - \frac{1}{R_{Rs}}$ --

Signed and Sealed this

Twelfth Day of June 1979

[SEAL]

Attest:

RUTH C. MASON
Attesting Officer

DONALD W. BANNER
Commissioner of Patents and Trademarks